US007296730B2

(12) United States Patent
Erdie

(10) Patent No.: US 7,296,730 B2
(45) Date of Patent: Nov. 20, 2007

(54) SHIPPING CONTAINER

(75) Inventor: Jason S. Erdie, Richfield, OH (US)

(73) Assignee: Erdie End Caps, LLC, Lorain, OH (US)

( * ) Notice: Subject to any disclaimer, the term of this patent is extended or adjusted under 35 U.S.C. 154(b) by 603 days.

(21) Appl. No.: 10/801,786

(22) Filed: Mar. 16, 2004

(65) Prior Publication Data

US 2005/0205648 A1 Sep. 22, 2005

(51) Int. Cl.
*B65D 43/04* (2006.01)
*B65D 43/18* (2006.01)

(52) U.S. Cl. ..... 229/125.17; 220/281; 220/345.3; 220/787; 220/788; 220/789; 229/5.5

(58) Field of Classification Search ..... 229/5.5, 229/93, 125.17, 125.28; 220/281, 297, 300, 220/786–789, 345.3; 206/407, 415, 416
See application file for complete search history.

(56) References Cited

U.S. PATENT DOCUMENTS 2,504,850 A 4/1950 Lermer
2,777,630 A 1/1957 Moberger
2,969,160 A 1/1961 Delk, Jr.
3,161,345 A 12/1964 McLeod
3,599,821 A 8/1971 Eggert et al.
3,913,774 A 10/1975 Vajtay
3,986,659 A 10/1976 Vajtay
4,196,818 A 4/1980 Brownbill
4,259,827 A * 4/1981 Stohlquist ..... 229/125.26
4,301,640 A 11/1981 Haas
4,380,447 A * 4/1983 VanderLugt, Jr. ..... 229/125.17
4,504,009 A * 3/1985 Boik et al. ..... 229/5.5
4,761,319 A * 8/1988 Kraus et al. ..... 220/787
4,801,039 A 1/1989 McCall et al.
4,811,857 A 3/1989 Thompson
4,886,947 A 12/1989 Thompson (Continued)

FOREIGN PATENT DOCUMENTS

DE 82 03 991.7 7/1982

OTHER PUBLICATIONS

ALMCO Group, Inc., undated screen capture image from web page " http://www.amclo.com/" showing exemplary plastic end caps for paper tubes.

(Continued)

*Primary Examiner*—Gary E Elkins
(74) *Attorney, Agent, or Firm*—Rankin, Hill, Porter & Clark LLP

(57) ABSTRACT

The present invention provides a shipping container, a paper tube, an end cap and a method. The shipping container includes a tube and an end cap. The tube has a cylindrical body and an open end. The cylindrical body has a mounting opening formed therein adjacent to the open end. The end cap includes a circular sidewall that is adapted to be received by the open end of the tube such that either the circular sidewall is surrounded by the cylindrical body or the cylindrical body is radially surrounded by the circular sidewall. The circular sidewall includes a projection that extends away from the circular sidewall and into the mounting opening so as to releasably secure the end cap to the tube.

21 Claims, 4 Drawing Sheets

U.S. PATENT DOCUMENTS

| | | | | |
|---|---|---|---|---|
| 5,005,759 | A * | 4/1991 | Bouche | 229/125.26 |
| 5,435,455 | A | 7/1995 | Pruss | |
| 5,699,959 | A | 12/1997 | Huspeka et al. | |
| 5,839,260 | A | 11/1998 | Brody | |
| 6,276,528 | B1 | 8/2001 | Nowotny et al. | |
| 6,401,952 | B1 | 6/2002 | Ming | |
| 6,792,977 | B2 | 9/2004 | Presby | |
| 2004/0040959 | A1 | 3/2004 | Menceles | |
| 2005/0161463 | A1 | 7/2005 | Litchman | |

OTHER PUBLICATIONS

Atom Marketing, Inc., undated screen capture image from web page "http://www.plasticendplugs.com/" showing exemplary plastic end caps for paper tubes.

Custom Paper Tubes, Inc., undated screen capture image from web page of "http://www.custompapertubes.com/closur.shtml" showing exemplary plastic end caps for paper tubes.

Western Container Corporation, undated screen capture image from web page http://www.thomasregister.com/olc/smartcat.aspx?az=70281001&type=details&ptno=P-1506K&TEMPLATE=/olc/70281001/template.htm&iheight=150&fontsize=2&stripecolor=cccccc&tablewidth=430&border=2&bordercolor=333300&BGCOLOR=ffffff"showing exemplary plastic end caps for paper tubes"

.

* cited by examiner

SHIPPING CONTAINER

BACKGROUND OF THE INVENTION

1. Field of Invention

The present invention relates to shipping containers and, more particularly, to shipping containers comprising a tube and an end cap that is releasably secured to the tube.

2. Description of Related Art

Paper tubes are conventionally formed by adhesively bonding two or more continuous strips of paper to each other in overlapping layers around a cylindrical mandrel and then cutting the paper cylinder or tube thus formed to desired length. The open ends of the paper tube can then be closed using end closures to form a shipping container that is both light in weight and strong. Shipping containers of this type are often used to ship large-format papers or photos, which can be rolled and stored inside the tube. Shipping containers of this type are provide more protection to contents stored within the tube and are easier to handle than oversized envelopes.

A variety of end closures are known in the art for closing the open end of a paper tube. A very popular type is known in the industry as a plastic end cap or plug. Conventional plastic plugs include a bottom wall having a substantially circular peripheral edge and a sidewall that extends from the peripheral edge. In most cases, the plastic plug further comprises an annular flange that extends from the sidewall. The outer diameter of the flange is typically larger than the inner diameter of the paper tube and thus the flange acts as a stop or limiting rim that prohibits the plug from being pressed completely into the paper tube. The plug is retained in the end of the paper tube by a friction fit between outer surface of the sidewall and the inner surface of the paper tube. One or more ribs or ridges are sometimes formed on the outer surface of the sidewall to improve contact between the outer surface of the sidewall and the inner surface of the paper tube.

Plastic plugs are relatively simple to manufacture, inexpensive and lightweight. In addition, they can easily be inserted into and removed from an open end of a paper tube by hand. These features make plastic plugs particularly suitable for use forming mailing tubes or other similar shipping containers.

There are some drawbacks with the use of plastic plugs, however. Plastic plugs can sometimes "pop" out of one or both ends of the paper tube, which then allows the contents of the container to spill out. The plugs can "pop" out when the paper tube is squeezed or when the contents of the container shift during transit and strike the interior side of the bottom wall causing it to become dislodged from the paper tube.

Adhesive tape is sometimes applied over the plastic plug in an effort to insure that the plastic plug remains in the tube. Alternatively, staples are sometimes used to secure the plastic plug to the paper tube. Both of these solutions are disadvantageous because they require additional time consuming steps or procedures. Moreover, use of adhesive or staples can damage the tube and/or end cap, which prevents reuse.

SUMMARY OF THE INVENTION

The present invention provides a shipping container comprising a tube and an end cap. The tube has a cylindrical body and an open end. At least one or, more preferably, a plurality of mounting openings are formed in the cylindrical body of the tube adjacent to the open end. The end cap comprising a circular sidewall that is adapted to be received by the open end of the tube. In a first embodiment of the invention, the circular sidewall is radially surrounded by the cylindrical body. In a second embodiment of the invention, the cylindrical body is radially surrounded by the circular sidewall. In both embodiments, the circular sidewall includes a projection that extends away from the circular sidewall and into the mounting opening so as to releasably secure the end cap to the tube.

Preferably, each projection is formed on a deflectable tab portion of the circular sidewall. Each projection preferably comprises a top edge portion that is arranged to contact against a top peripheral portion of the mounting opening, which prevents withdrawal of the end cap from the tube. Each projection also preferably comprises a bottom ramp portion that is arranged opposite the top edge portion for promoting deflection of the deflectable tab when the end cap is received by the open end of the tube, and a side ramp portion that is arranged between the top edge portion and the bottom ramp portion to promote deflection of the deflectable tab when the end cap is rotated relative to the tube at a time when the projection extends into the mounting opening. The end cap preferably further comprises an end wall that extends between the circular sidewall. The end wall can further comprise a handle portion for facilitating rotation of the end cap relative to the tube.

In the first embodiment of the invention, the end cap is pressed into the open end of the tube, which causes the cylindrical body of the tube to radially surround the circular sidewall of the end cap. As the end cap is being pressed into and received by the open end of the tube, the bottom ramp of the projection contacts the cylindrical body of the tube at the perimeter of the open end which causes the deflectable tab to be deflected inwardly. If the projection is aligned with the corresponding mounting opening, the spring force provided by the deflectable tab causes the tab to spring back and extend the projection into the mounting opening. If the projection is not aligned with the corresponding mounting opening, the end cap can be rotated relative to the tube to align the projection with the mounting opening.

The end cap can be selectively released from the tube simply by rotating the end cap relative to the tube. The side ramp portion of the projection causes the deflectable tab to be deflected inwardly until the top edge portion of the projection is no longer aligned with and thus cannot contact the top peripheral portion of the mounting opening. After rotation, the end cap can simply be withdrawn from the tube by pulling the end cap from the tube. The handle portion of the end wall facilitates both rotation and removal of the end cap from the tube.

The shipping container according to the invention is light in weight and very strong. The end cap can be releasably secured to the tube to close off the open end without the need for special tools. Furthermore, the end cap is very difficult to accidentally or unintentionally dislodge from the tube. However, it can be easily removed by hand and reused. No fasteners or adhesives of any type need be used to keep the end cap secured to the tube.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE PREFERRED EMBODIMENTS

Figure 1:
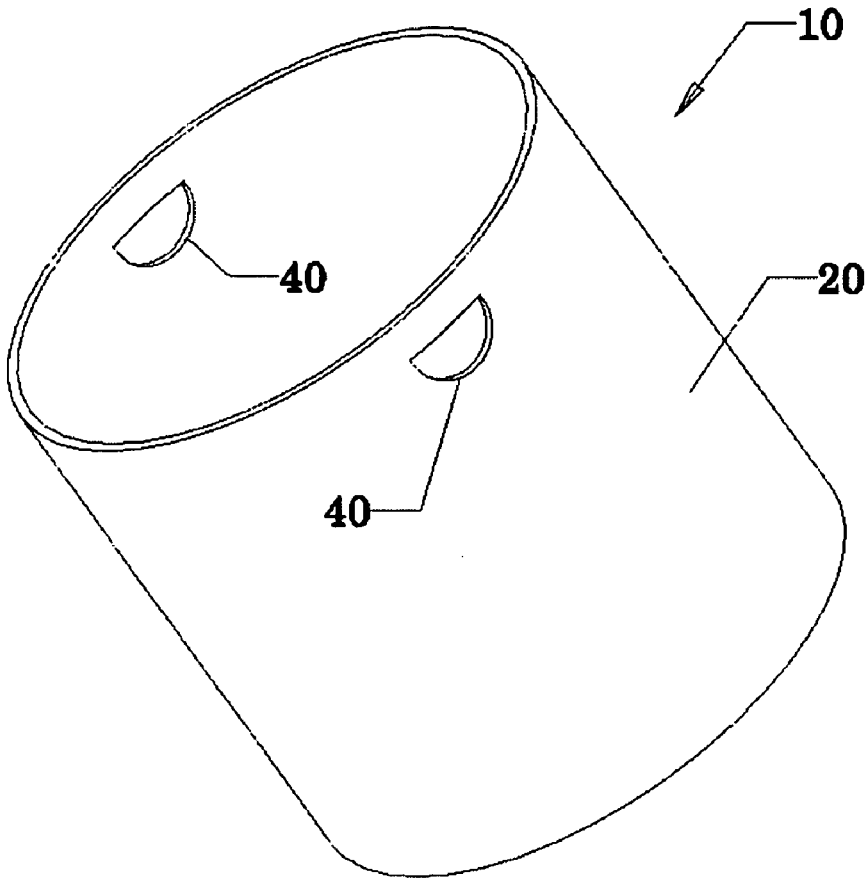
FIG. 1 is a perspective view of a paper tube according to the present invention.

A perspective view of a paper tube 10 according to the invention is shown in FIG. 1. The paper tube 10 comprises a cylindrical body 20 having at least one open end 30. At least one or, more preferably, a plurality of mounting opening 40 are formed in the cylindrical body 20 adjacent to the open end 30. Preferably, a plurality of mounting openings 40 are spaced an equal distance apart radially about the cylindrical body 20 adjacent to the open end 30.

The paper tube 10 can be of any size. Paper tubes 10 having an inner diameter of from about two inches to about four inches are preferably provided with either two, three or four mounting openings 40 formed in the cylindrical body 20 adjacent to the open end. Paper tubes having an inner diameter of greater than about four inches to about seven inches are preferably provided with five, six, seven, eight or more mounting openings 40.

The wall thickness of the cylindrical body 20 is preferably within the range of from about 0.050 inches to about 0.250 inches, with wall thicknesses of 0.070 inches to about 0.125 inches being most preferred. The cylindrical body can be of any desired length. The paper tube can be formed using conventional paper tube manufacturing techniques. The mounting holes 40 can be formed by cutting, punching or by other forming means.

Figure 2:
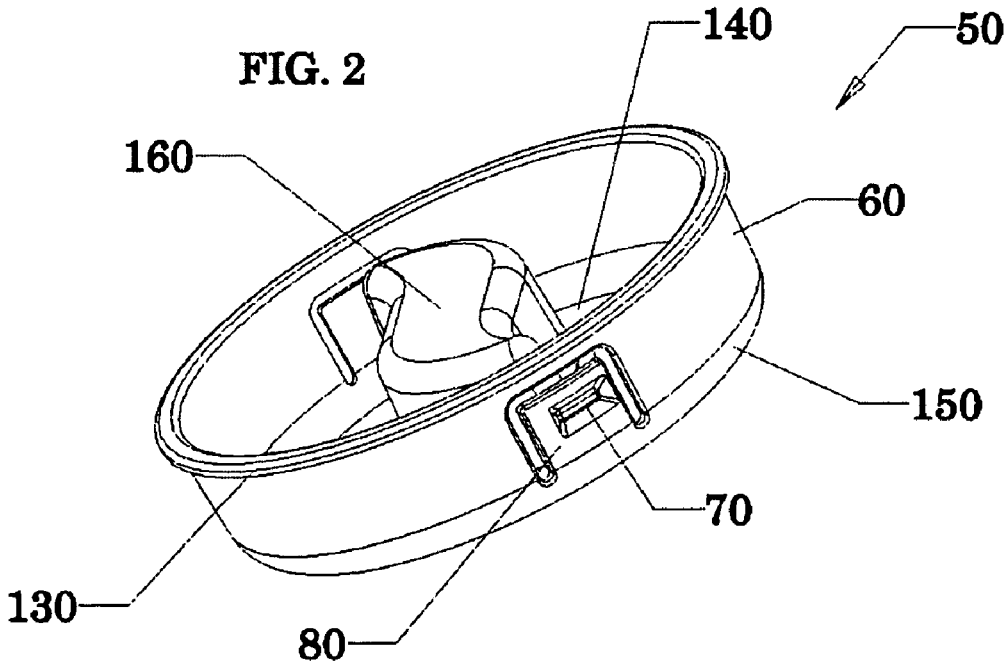
FIG. 2 is a perspective view of a first embodiment of an end cap according to the present invention.

A perspective view of an exemplary end cap 50 according to a first embodiment of the invention is shown in FIG. 2. In the first embodiment of the invention, the end cap 50 comprises a circular sidewall 60 and at least one or, more preferably, a plurality of projections 70 that extend or project outwardly away from the circular sidewall 20.

Figure 3:
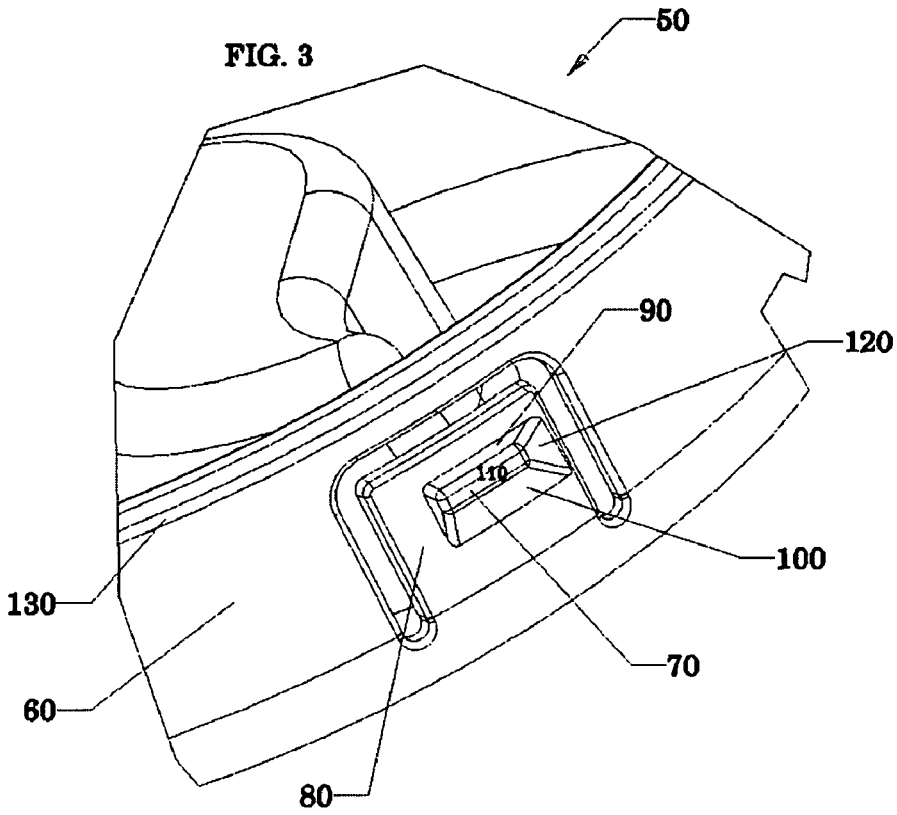
FIG. 3 is a detailed perspective view of a portion of the end cap shown in FIG. 2.

With reference to FIG. 3, which shows a detailed perspective view of a portion of the end cap 50 shown in FIG. 2, each projection 70 is preferably formed on a deflectable tab portion 80 of the circular sidewall 20. The shape and orientation of the deflectable tab portion 80 is not critical, and a variety of shapes or configurations can be used. However, the deflectable tab portion 80 should be sized and configured to facilitate sufficient inward deflection of the tab portion 80 that a top edge portion 90 of the projection 70 does not extend beyond the circular sidewall 60 of the end cap 50 (or a cylinder defined by the circular sidewall 60). This is necessary in order to facilitate removal of the end cap 50 from the paper tube 10. As is shown in FIG. 3, the projection 70 also preferably comprises a bottom ramp portion 100 arranged on a side opposite the top edge portion 90. The bottom ramp portion 100 preferably provides a gradual or angled approach from the circular sidewall 60 (or the cylinder defined thereby) to a tip 110 or farthest point of the projection 70. The bottom ramp portion 100 promotes inward deflection of the deflectable tab portion 80 when the end cap 50 is pressed into the open end 30 of the tube 10.

The projection 70 also preferably comprises a side ramp portion 120 that is arranged on either or both sides of the projection 70 between the top edge portion 90 and the bottom ramp portion 100. Like the bottom ramp portion 100, the side ramp portion 120 provides a gradual or angled approach from the circular sidewall 60 (or the cylinder defined thereby) to a tip 110 or farthest point of the projection 170.

It will be appreciated that the shape of the projection 70 is not per se critical, and that rounded "bumps" with a generally flat top edge portion 90 or other shapes could be used. It will also be appreciated that the deflectable tab portion 80 and the projection 70 can be coextensive. It is important, however, that the top edge portion 90 of the projection 70 be able to contact the top peripheral edge 180 of the mounting opening 40 to prevent the removal of the end cap 50 from the tube 10, and that the projection 70 be able to be positioned (by rotation) such that it no longer projects into the mounting opening 40.

The end cap 50 also preferably comprises a peripheral rim portion 130 that extends beyond the circular sidewall 60 and an end wall 140 that extends between the circular sidewall 60. The end wall 140 can extend between the circular sidewall 60 at any point (i.e., at the bottom or at the top or at any point in between). In FIG. 2, the end wall 140 extends from a lower or bottom portion 150 of the circular sidewall 60. Preferably, the end wall 140 further comprises a handle portion 160 for facilitating rotation of the end cap 50 relative to the tube 10. The shape and configuration of the handle portion 160 is not critical, but should provide a comfortable gripping surface for one's fingers.

The end cap is preferably formed of a plastic material such as polystyrene, polyethylene, polypropylene, nylon and/or one or more other thermoplastic or thermosetting polymers. The end cap can be formed using conventional molding or fabricating processes and equipment.

Figure 4:
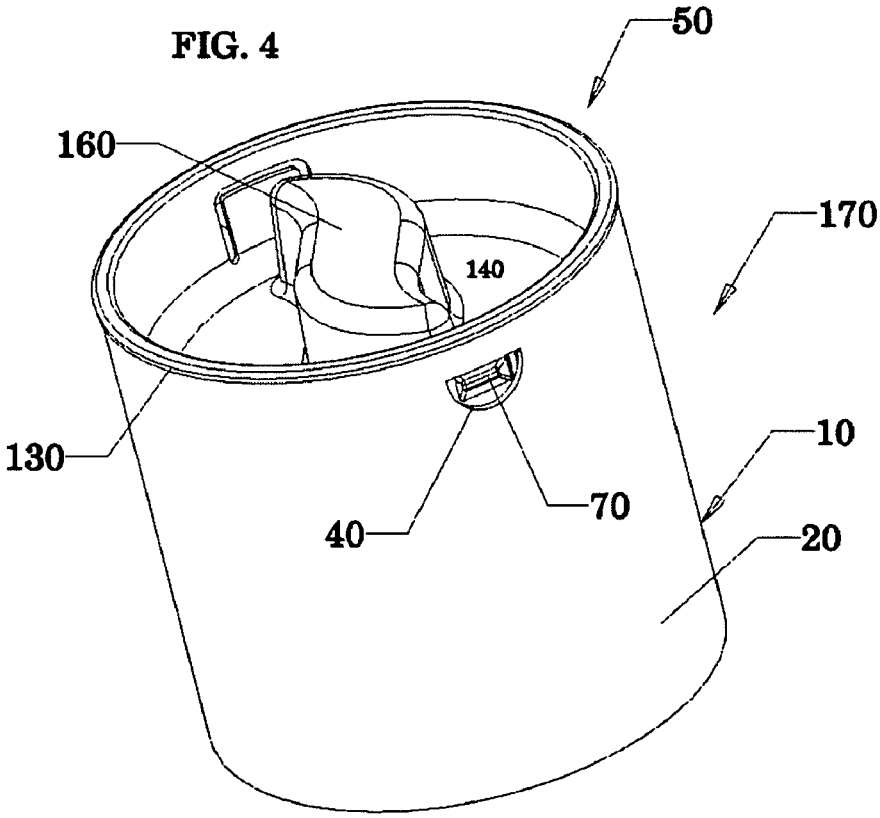
FIG. 4 is a perspective view of a first embodiment of a shipping container according to the invention.

FIG. 4 shows a perspective view of an exemplary shipping container 170 that can be formed by joining a tube 10 and an end cap 50 according to a first embodiment of the invention together. As shown in FIG. 4, the end cap 50 closes or seals off the open end 30 of the tube 10. The end cap 50 is received within the open end 30 of the tube 10 such that the cylindrical body 20 radially surrounds the circular sidewall 60. At least one projection 70 extends away from the circular sidewall 60 and into a corresponding mounting opening 40 so as to releasably secure the end cap 50 to the tube 10.

Figure 5:
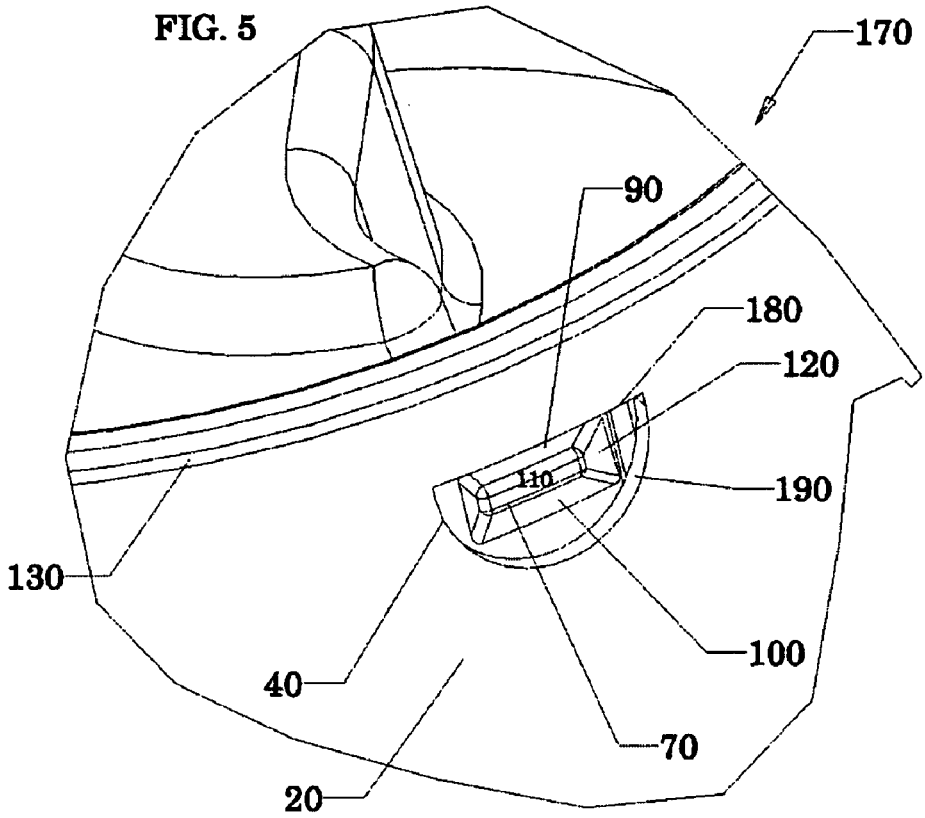
FIG. 5 is a detailed perspective view of a portion of the shipping container shown in FIG. 4.

With reference to FIG. 5, which shows a detailed perspective view of a portion of the shipping container 170 shown in FIG. 4, the top edge portion 90 of the projection 70 is arranged to contact against a top peripheral portion 180 of the mounting opening 40 to thereby prevent withdrawal of the end cap 50 from the tube 10. Rotation of the end cap 50 relative to the tube 10, however, causes the side ramp portion 120 to contact a side peripheral portion 190 of the mounting opening 40, which causes inward deflection of the deflectable tab portion 80 sufficient to prevent engagement or contact between the top edge portion 90 and the top peripheral portion 180 of the mounting opening 40. Once the projection 70 is no longer aligned with and extending into the mounting opening 40, the end cap 50 can simply be withdrawn or pulled from the open end 30 of the tube 10.

Figure 6:
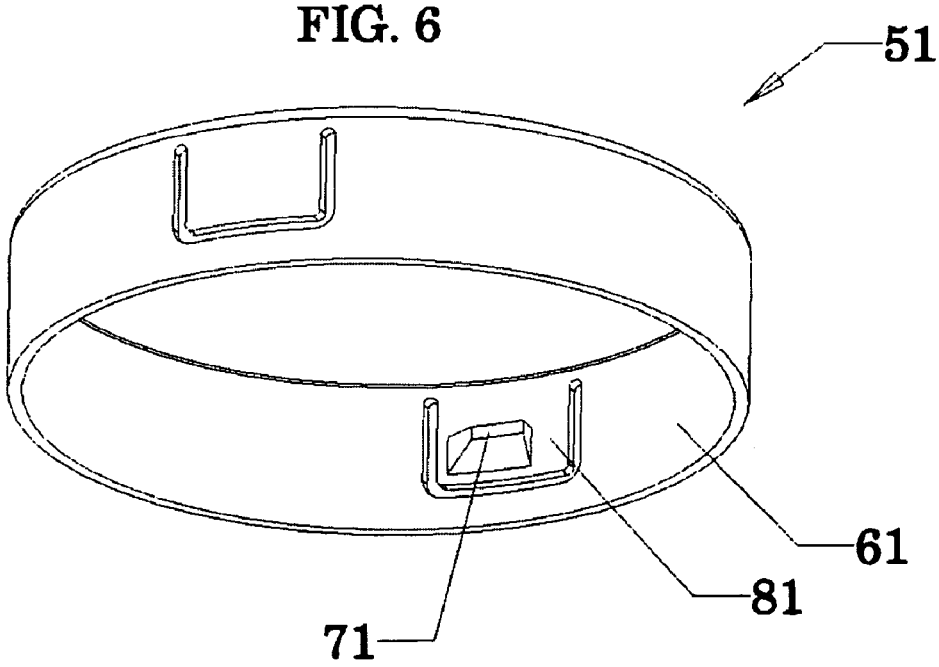
FIG. 6 is a perspective view of a second embodiment of an end cap according to the present invention.

FIG. 6 shows an exemplary end cap 51 in accordance with a second embodiment of the invention. The end cap 51 according to the second embodiment of the invention is substantially similar to the end cap 50 according to the first embodiment of the invention, except that it is configured to radially surround the cylindrical body 20 of the tube 10 rather than be radially surrounded thereby. Accordingly, the end cap 51 comprises a circular sidewall 61 and one or, more preferably, a plurality of projections 71. The projections 71 extend inwardly away from the circular sidewall 61. Preferably, the projections 71 are formed on deflectable tab portions 81 of the circular sidewall 61. The projections preferably include a top edge portion, a bottom ramp portion, and at least one side ramp portion.

Figure 7:
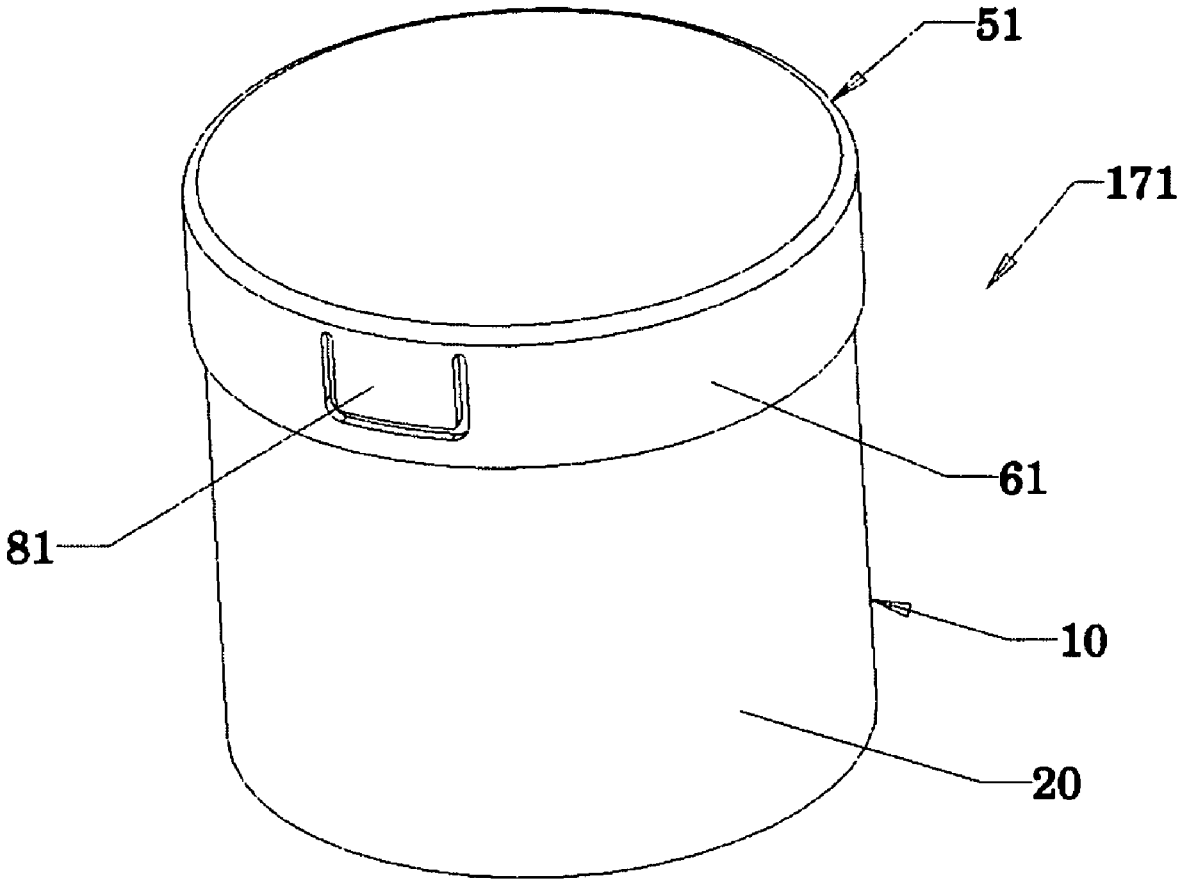
FIG. 7 is a perspective view of a second embodiment of a shipping container according to the invention.

FIG. 7 shows a perspective view of an exemplary shipping container 171 according to a second embodiment of the invention. The shipping container 171 includes an end cap 51 having a circular sidewall 61 that radially surrounds a cylindrical body 20 of a tube 10 adjacent to an open end. Projections 71 extending inwardly away from the circular sidewall 61 extend into the mounting openings 40 formed in the cylindrical body 20 of the tube adjacent to the open end and thereby prevent the unintentional removal of the end cap 51 from the tube 10.

No handle portion need be provided on the end cap 51. A user simply grips the circular sidewall 61 and twists or rotates it relative to the tube 10. The side ramp (not shown) contacts the side peripheral portion of the mounting opening and thereby deflects the deflectable tab portion of the end cap outwardly until the top edge portion of the projection 71 is not longer aligned with and extending into the mounting opening or in contact with the top peripheral portion of the mounting opening. The end cap 51 can thereafter be withdrawn or pulled away from the tube 10.

Thus, the present invention provides methods of releasably securing an end cap to a tube. A first embodiment of a method of the invention comprises: (1) providing a tube comprising a cylindrical body having at least one open end and a plurality of mounting openings formed therein adjacent to the open end; (2) providing an end cap comprising a circular sidewall having a plurality of projections that extend away from the circular sidewall, each projection being formed on a deflectable tab portion of the circular sidewall; and (3) pressing the end cap into the open end of the tube until the cylindrical body surrounds the circular sidewall and the plurality of projections extend into the plurality of mounting openings to releasably secure the end cap to the tube. Material to be shipped can be placed within the tube before the end cap is secured thereto. In addition, shrink film or paper strips can be applied over the end cap to provide a tamper resistant or tamper evident container. The method preferably further comprises: (4) rotating the end cap relative to the tube until the projection is not received within the mounting opening; and (5) pulling the end cap from the tube.

A second embodiment of a method of the invention comprises: (1) providing a tube comprising a cylindrical body having at least one open end and a plurality of mounting openings formed therein adjacent to the open end; (2) providing an end cap comprising a circular sidewall having a plurality of projections that extend away from the circular sidewall, each projection being formed on a deflectable tab portion of the circular sidewall; and (3) pressing the end cap into the open end of the tube until the circular sidewall surrounds the cylindrical body and the plurality of projections extend into the plurality of mounting openings to releasably secure the end cap to the tube. Material to be shipped can be placed within the tube before the end cap is secured thereto. In addition, shrink film or paper strips can be applied over the end cap to provide a tamper resistant or tamper evident container. The method preferably further comprises: (4) rotating the end cap relative to the tube until the projection is not received within the mounting opening; and (5) pulling the end cap from the tube.

The present invention is particularly useful for forming reusable shipping containers. The end caps can be securely attached to the paper tubes quickly and without the need for special tooling, and can be removed with relative ease. The end caps of shipping tubes formed in accordance with the invention are significantly more difficult to unintentionally dislodge from an open end of a paper tube than conventional plastic plugs or other end closures.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A shipping container comprising:

a tube having a cylindrical body, an open end, and a mounting opening formed in the cylindrical body adjacent to the open end; and an end cap adapted to be releasably secured to the tube, the end cap having a circular sidewall that is adapted to be received within the open end of the tube such that the circular sidewall is radially surrounded by the cylindrical body of the tube, an opening provided through the circular sidewall that defines and extends substantially around a deflectable tab portion of the circular sidewall, and a projection formed on the deflectable tab portion of the circular sidewall that is adapted to extend into the mounting opening formed in the cylindrical body of the tube when the circular sidewall is received within the open end of the tube so as to releasably secure the end cap to the tube.

2. The shipping container according to claim 1 wherein a plurality of mounting openings are formed in the cylindrical body of the tube adjacent to the open end, and wherein the circular sidewall of the end cap includes a corresponding plurality of projections formed on a corresponding plurality of deflectable tab portions.

3. The shipping container according to claim 2 wherein the plurality of mounting openings are spaced an equal distance apart radially about the cylindrical body adjacent to the open end, and wherein the plurality of projections are spaced equal distance apart radially about the circular sidewall.

4. The shipping container according to claim 1 wherein the projection comprises a top edge portion that is arranged to contact against a top peripheral portion of the mounting opening and thereby prevent withdrawal of the end cap from the tube.

5. The shipping container according to claim 4 wherein the projection further comprises a bottom ramp portion arranged opposite the top edge portion for promoting inward deflection of the deflectable tab when the end cap is pressed into the open end of the tube.

6. The shipping container according to claim 5 wherein the projection further comprises a side ramp portion arranged between the top edge portion and the bottom ramp portion, the side ramp portion promoting inward deflection of the deflectable tab when the end cap is rotated relative to the tube when the projection is extending into the mounting opening.

7. The shipping container according to claim 1 wherein the end cap further comprises a peripheral rim portion that extends beyond the circular sidewall, the peripheral rim portion contacting a perimeter of the open end of the tube to limit the extent to which the end cap can be received within the open end of the tube.

8. The shipping container according to claim 1 wherein the end cap further comprises an end wall that extends between the circular sidewall.

9. The shipping container according to claim 8 wherein the end wall further comprises a handle portion for facilitating rotation of the end cap relative to the tube.

10. The shipping container according to claim 1 wherein the tube is formed of spirally wound strips of paper.

11. The shipping container according to claim 1 wherein the end cap is formed of plastic.

12. The shipping container according to claim 1 wherein the cylindrical body has an inner diameter of from about two inches to about seven inches.

13. The shipping container according to claim 1 wherein the cylindrical body has a wall thickness of from about 0.050 inches to about 0.250 inches.

14. A method for closing a shipping container that comprises:

a tube having
- a cylindrical body,
- an open end, and
- a plurality of mounting openings formed in the cylindrical body adjacent to the open end; and an end cap adapted to be releasably secured to the tube, the end cap having
- a circular sidewall that is adapted to be received within the open end of the tube such that the circular sidewall is radially surrounded by the cylindrical body of the tube,
- a plurality of openings provided through the circular sidewall each defining and extending substantially around a deflectable tab portion of the circular sidewall; and
- a plurality of projections formed on the deflectable tab portions of the circular sidewall that are adapted to extend into the plurality of mounting openings formed in the cylindrical body of the tube when the circular sidewall is received within the open end of the tube;

the method comprising:

pressing the end cap into the open end of the tube such that the cylindrical body surrounds the circular sidewall and contact between the plurality of projections and the cylindrical body causes inward deflection of the deflectable tab portions of the circular sidewall; and orienting the end cap within the open end of the tube such that the plurality of projections extend into the plurality of mounting openings and thereby releasably secure the end cap to the tube.

15. The method according to claim 14 wherein each projection further comprises a bottom ramp portion that is configured to promote inward deflection of the deflectable tab when the end cap is pressed into the open end of the tube.

16. The method according to claim 15 wherein each projection further comprises a top portion that is configured to contact against a top peripheral portion of the mounting opening and thereby prevent withdrawal of the end cap from the tube.

17. The method according to claim 16 wherein each projection further comprises a side ramp portion arranged between the top edge portion and the bottom ramp portion, the side ramp portion promoting inward deflection of the deflectable tab when the end cap is rotated relative to the tube when the projection is extending into the mounting opening.

18. A method for opening a shipping container that comprises:

a tube having
- a cylindrical body,
- an open end, and
- a plurality of mounting openings formed in the cylindrical body adjacent to the open end; and an end cap having
- a circular sidewall received within the open end of the tube such that the circular sidewall is radially surrounded by the cylindrical body of the tube,
- a plurality of openings provided through the circular sidewall that define a plurality of deflectable tab portions of the circular sidewall; and
- a plurality of projections formed on the deflectable tab portions of the circular sidewall that extend into the plurality of mounting openings formed in the cylindrical body of the tube;

the method comprising:

rotating the end cap relative to the tube until the plurality of projections are not received within the mounting openings; and pulling the end cap out of the open end of the tube.

19. The method according to claim 18 wherein each projection further comprises a bottom ramp portion that is configured to promote inward deflection of the deflectable tab when the end cap is pressed into the open end of the tube.

20. The method according to claim 19 wherein each projection further comprises a top portion that is configured to contact against a top peripheral portion of the mounting opening and thereby prevent withdrawal of the end cap from the tube.

21. The method according to claim 20 wherein each projection further comprises a side ramp portion arranged between the top edge portion and the bottom ramp portion, the side ramp portion promoting inward deflection of the deflectable tab when the end cap is rotated relative to the tube when the projection is extending into the mounting opening.

* * * * *